United States Patent [19]

Kaneko

[11] Patent Number: 4,798,486

[45] Date of Patent: Jan. 17, 1989

[54] INK RIBBON CASSETTE HAVING MOUNTING MEANS, SLACK PREVENTING MEANS AND MULTIPLE RIBBON SHIFTING MEANS

[75] Inventor: Masanori Kaneko, Kawasaki, Japan

[73] Assignee: Canon Kabushiki Kaisha, Tokyo, Japan

[21] Appl. No.: 854,862

[22] Filed: Apr. 23, 1986

[30] Foreign Application Priority Data

Apr. 26, 1985 [JP] Japan ..... 60-88994

[51] Int. Cl.[4] ..... B41J 32/00

[52] U.S. Cl. ..... 400/208; 400/212; 400/214; 400/228; 400/234; 400/248; 400/697.1

[58] Field of Search ..... 400/207, 208, 208.1, 400/212, 214, 228, 234, 248, 695, 696, 697, 697.1

[56] References Cited

U.S. PATENT DOCUMENTS

| | | | |
|---|---|---|---|
| 3,184,028 | 5/1965 | Kleinschmidt et al. | 400/248 X |
| 3,604,549 | 9/1971 | Caudill et al. | 400/208 |
| 3,877,561 | 4/1975 | Guerrini et al. | 400/248 X |
| 3,900,099 | 8/1975 | Hengelhaupt | 400/234 X |
| 3,941,231 | 3/1976 | Matuck et al. | 400/196.1 |
| 3,977,512 | 8/1976 | Teagarden et al. | 400/248 X |
| 4,010,839 | 3/1977 | Guerrini et al. | 400/207 |
| 4,074,799 | 2/1978 | Hishida et al. | 400/234 X |
| 4,091,914 | 5/1978 | Stipanuk | 400/196.1 |
| 4,203,677 | 5/1980 | Hatsell | 400/214 |
| 4,213,715 | 7/1980 | Haftmann et al. | 400/207 X |
| 4,401,394 | 8/1983 | Hume et al. | 400/234 X |
| 4,406,553 | 9/1983 | Nally et al. | 400/234 X |
| 4,423,973 | 1/1984 | Theilen | 400/208 |
| 4,609,298 | 9/1986 | Shioda | 400/228 X |
| 4,623,272 | 11/1986 | Kondo | 400/208 |
| 4,624,592 | 11/1986 | Purcell | 400/196.1 X |
| 4,645,363 | 2/1987 | Andersson | 400/234 X |
| 4,657,418 | 4/1987 | Lahr | 400/248 X |

FOREIGN PATENT DOCUMENTS

| | | | |
|---|---|---|---|
| 0042955 | 1/1982 | European Pat. Off. . | |
| 0199355 | 10/1986 | European Pat. Off. | 400/248 |
| 2930127A1 | 2/1981 | Fed. Rep. of Germany . | |
| 3106958 | 10/1982 | Fed. Rep. of Germany . | |
| 0219152 | 2/1985 | German Democratic Rep. | 400/208 |
| 0059488 | 4/1984 | Japan | 400/248 |
| 0104984 | 6/1984 | Japan | 400/214 |
| 0109382 | 6/1984 | Japan | 400/208 |
| 0194883 | 11/1984 | Japan | 400/248 |
| 0209187 | 11/1984 | Japan | 400/208 |
| 0224378 | 12/1984 | Japan | 400/248 |
| 0104374 | 6/1985 | Japan | 400/208 |
| 2091684A | 8/1982 | United Kingdom . | |
| 2148796 | 6/1985 | United Kingdom | 400/212 |

OTHER PUBLICATIONS

IBM Technical Disclosure Bulletin, "Tracking Roll", Baumberger et al, vol. 21, No. 8, Jan. 1979, p. 3126.

*Primary Examiner*—Ernest T. Wright, Jr.
*Attorney, Agent, or Firm*—Fitzpatrick, Cella, Harper & Scinto

[57] ABSTRACT

There is provided an ink ribbon cassette detachably mounted on a carriage of a recording apparatus, housing an ink ribbon supplied from a casing and taken up therein after passing through a recording section and including first positioning means for positioning the ink ribbon cassette in a first direction when the ink ribbon cassette is mounted on the carriage, and second positioning means for positioning the ink ribbon cassette in a second direction when the ink ribbon cassette is mounted on the carriage, wherein at least one of the first and second positioning means is elastically engaged with positioning means of the carriage, and inclined portions are formed at ink ribbon exit and entrance portions in the widthwise direction of the ink ribbon. A tension spring is included to prevent slackening of the ink ribbon in the cassette.

3 Claims, 4 Drawing Sheets

INK RIBBON CASSETTE HAVING MOUNTING MEANS, SLACK PREVENTING MEANS AND MULTIPLE RIBBON SHIFTING MEANS

BACKGROUND OF THE INVENTION

1. Field of the Invention

The present invention relates to an ink ribbon cassette and, more particularly, to an ink ribbon cassette which houses an ink ribbon drawn from a cassette casing and taken up inside the casing through a recording section, and which is detachably mounted on a carriage of a recording apparatus.

2. Related Background Art

In order to align an ink ribbon cassette of this type in back-and-forth and left-and-right directions, two bosses are arranged on a carriage which mounts the ribbon cassette, a round hole is formed in the cassette at a position corresponding to one boss and an elongated hole is formed at a position corresponding to the other boss.

With this arrangement, however, the ink ribbon cassette must be mounted on the carriage so that the holes are immediately above the corresponding bosses. In order to prevent the cassette from being accidentally disengaged upward, the ink ribbon cassette must be fixed by a fixing means after the corresponding boss is engaged with the round hole. When the ink ribbon cassette is to be disengaged, the cassette must be pulled directly upward after the fixing means is released.

Since the casing of the ink ribbon cassette is fixed and the drawn ink ribbon is moved vertically, upper and lower positions of supply and take-up sections of the cassette must be defined so as not to be influenced by the vertical movement of the exposed ink ribbon. For this reason, slits, which are wide enough to allow smooth passage of the ink ribbon, are formed in the casing. However, since the slit width is small, the edge of the vertically moving ribbon abuts against the slit edge to be bent or to have ink removed therefrom. If the slit width is increased, the ribbon shifts widely in the vertical direction on the take-up side, resulting in irregular winding.

In order to prevent slackening of the ink ribbon at the supply side, a small tension force is applied to the ink ribbon. This tension member normally comprises a spring. However, since a normal spring has a small radius of curvature, when the ribbon receives a large tension force or receives a tension force for a long period of time, it may be bent or a printing operation may be interfered with.

SUMMARY OF THE INVENTION

It is, therefore, an object of the present invention to provide an ink ribbon cassette which can be accurately and reliably positioned on a carriage, and which allows regular taking up of an ink ribbon.

It is another object of the present invention to prevent slackening of an ink ribbon when an ink ribbon cassette is disengaged from a carriage.

It is still another object of the present invention to provide an ink ribbon feed mechanism which is free from ink ribbon slackening when an ink ribbon cassette is disengaged from a carriage.

It is still another object of the present invention to provide an ink ribbon feed mechanism which can shift an ink ribbon exposed from an ink ribbon cassette in its widthwise direction in response to a recording operation, while a ribbon cassette casing is fixed, and which is free from ink ribbon slackening when the ink ribbon is shifted without being fed.

The above and other objects of the present invention will be apparent from the following detailed description.

DETAILED DESCRIPTION OF THE PREFERRED EMBODIMENT

An embodiment of the present invention will be described in detail with reference to the accompanying drawings.

Figure 1:
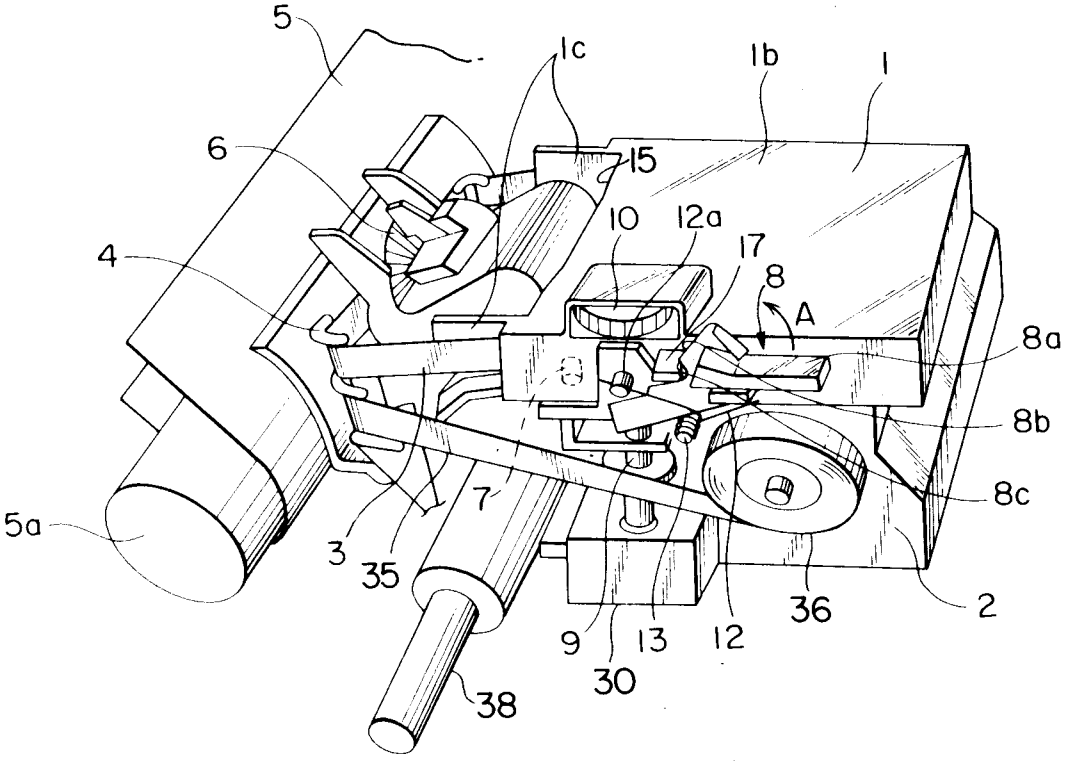
FIG. 1 is a perspective view of an ink ribbon cassette mounted on a carriage.
Figure 3:
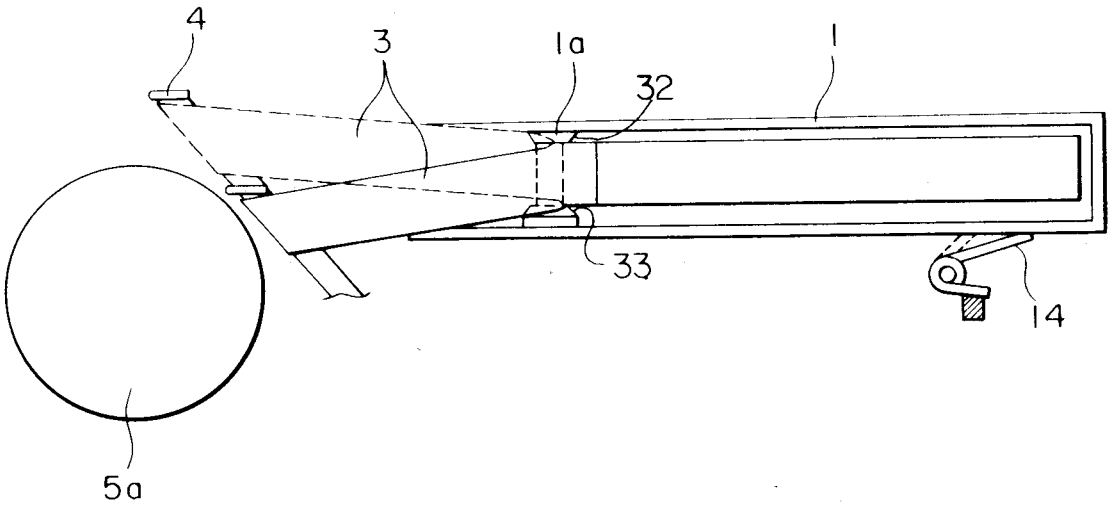
FIG. 3 is a sectional view showing vertical movement of an ink ribbon in standby and delete positions.

FIG. 1 shows a state wherein an ink ribbon cassette 1 is mounted on a carriage 2 which is supported by support shaft 38. An ink ribbon 3 drawn from the ink ribbon cassette 1 and a correction ribbon 35 is drawn from reel 36, and are guided along ribbon guides 4 and are selectively held between a recording sheet 5, wound around a platen 5*a*, and a printing element (e.g., a daisy wheel) 6. The ribbon guides 4 are moved vertically to be set at print, delete, and standby positions; the standby and delete positions are shown in FIG. 3.

The ink ribbon cassette 1 has an elongated hole 11 (FIG. 2) engaged with a boss 7 extending from the carriage 2. When the hole 11 is engaged with the boss 7, the cassette 1 is aligned in the left-and-right direction.

Plate-like fixing ribs 17 extend from two side surfaces 31 of the cassette 1. Fixing pawls 8, which are biased in a direction indicated by arrow A by coil springs 12 about shafts 13, are pivotally arranged on the carriage 2 at positions corresponding to the ribs 17. Each fixing pawl 8 has a pressing portion 8*a*. When the pressing portion 8*a* is pressed downward, the fixing pawl 8 is pivoted in a direction opposite to the direction of arrow A, against a biasing force of the corresponding coil spring 12, one end of which abuts against a projection 12*a*, thus disengaging it from the rib 17.

The fixing pawls 8 also have inclined portions 8*b* When the ink ribbon cassette 1 is mounted, the ribs 17 are guided along the inclined portions 8*b* and engaged with the corresponding ribs 17 at engaging portions 8*c* of fixing pawls 8.

Figure 2:
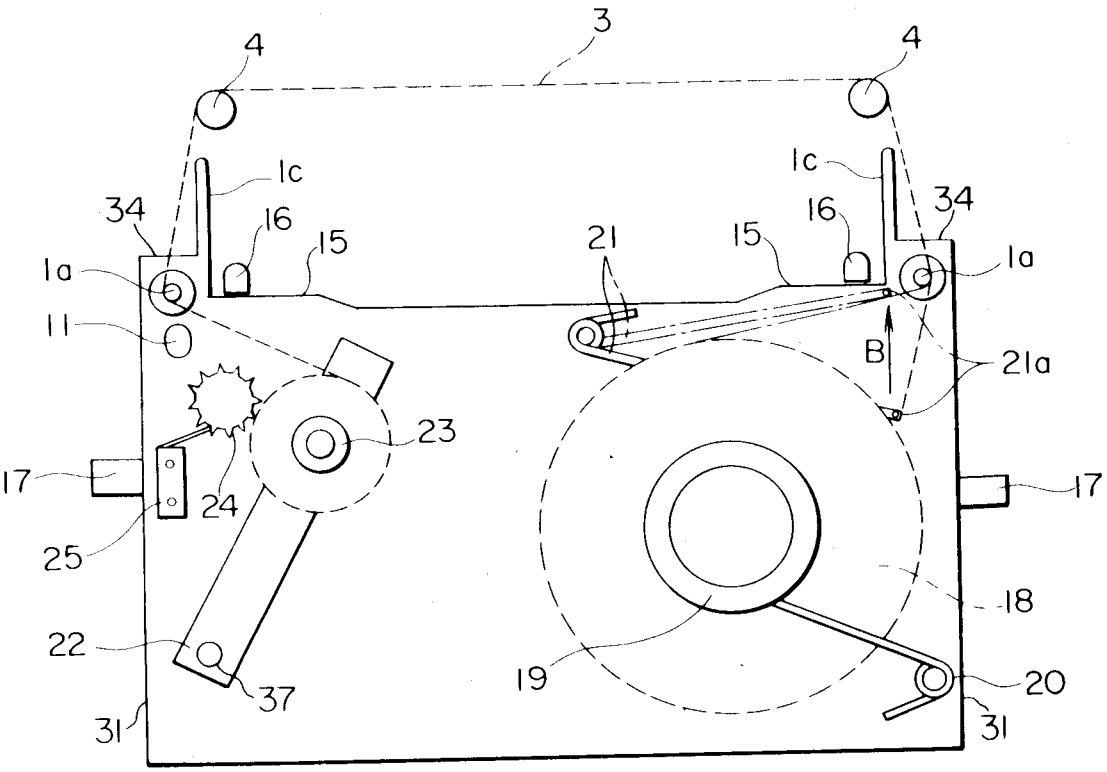
FIG. 2 is a plan view of an internal structure of the ink ribbon cassette.

As shown in FIG. 2, the ink ribbon 3, supplied from a supply roll 18 fitted on a core 19, is wound around a take-up hub 23, axially supported by a take-up lever 22 which pivots on point 37 through ribbon guides 4 and guide bosses 1*a* having an upper inclined portion 32 and lower inclined portion 33. When a feed gear 24 provided on a take-up knob 10 is rotated by a motor 30 or the like, the ribbon 3 is taken up by the hub 23. A spring 25 prevents reverse rotation of the knob 10. Similarly, a detent spring 20 on the supply side applies a resistance force against the rotation of the supply roll 18.

A tension spring 21 is arranged near an ink ribbon drawing portion of the cassette 1 to apply a given tension force to the drawn ink ribbon 3. When a large tension force is applied to the ink ribbon 3 (e.g., when the ribbon 3 is taken up), the tension spring 21 is moved in a direction indicated by arrow B to transfer the bent portion of the ribbon 3 from a distal end 21*a* of the tension spring 21, which has a small radius of curvature, to the corresponding guide boss 1*a*, which has a large radius of curvature.

The tension spring 21 thus applies the tension force to the ribbon 3 at its distal end 21*a*. Therefore, when the ink ribbon cassette 1 is disengaged from the carriage 2, the slackened portion of the ribbon 3 is returned to a cassette casing 1*b* and is extended between a pair of guide arms 1*c* to remove the slackening of the ribbon 3. In this embodiment, only the exposed portion of the ribbon 3 is shifted vertically by the ribbon guides 4, while the cassette casing 1*b* is fixed in position. The shift operation requires a variation in length of the exposed ribbon 3, as shown in FIG. 3, and a variation in the length of the exposed ribbon 3 is absorbed by movement of the distal end 21*a* of the tension spring 21. Therefore, an appropriate tension force can be applied to the ink ribbon 3 without slackening, regardless of the shift operation.

As described above, when the ribbon cassette 1 is disengaged from the carriage 2 (acting as a cassette holding means), the ink ribbon 3 is extended between the guide arms 1*c* while the back surface thereof is supported thereby. The guide arms 1*c* are configured in a substantially plate-like shape. This does not interfere with movement of the ribbon 3 when it is exposed from openings 34 (exit and entrance portions of the casing 1*b*) near the bosses 1*a* and is shifted by the ribbon guides 4 in its widthwise direction.

A method of mounting/demounting the ink ribbon cassette 1 with the above arrangement on the carriage 2, and an ink ribbon feed operation will now be described.

When the ink ribbon cassette 1 is to be mounted on the carriage 2, it is pressed downward against biasing forces of the coil spring 12 and a coil spring 14. At this time, the fixing pawls 8 are guided along the inclined portions 8*b*, and are pivoted in a direction opposite the direction of arrow A, against the biasing force of the coil springs 12. When the pawls 8 are guided to the engaging portions 8*c*, they are pivoted in the direction of arrow A and engaged with the ribs 17. The cassette 1 is urged against the upper surface of the carriage 2 by the biasing force of the springs 12, one end of each of which abuts against the corresponding pawl 8. The pawls 8 produce a moment about the shafts 13, thus moving the corresponding ribs 17 forward. As shown in FIG. 2, a front wall 15 of the cassette 1 abuts against projections 16 extending from the carriage 2.

The cassette 1 is thus positioned in the left-and-right direction by engaging the boss 7 on the carriage 2 with the elongated hole 11 formed in the cassette 1. The fixing pawls 8 push the ribs 17 forward, and he front wall 15 of the cassette 1 abuts against the projections 16 on the carriage 2, thereby positioning the cassette 1 in the back-and-forth direction.

Since the take-up knob 10 is positioned at an upper left portion of the recording apparatus, near the boss 7 and the front wall 15 (FIG. 2), it can be accurately meshed with a ribbon rotating shaft 9. This position of the knob 10 also allows a maximum take-up of the ribbon 3 in the limited area of the cassette 1.

When the cassette 1 is to be disengaged from the carriage 2, the pressing portions 8*a* of the fixing pawls 8 are pressed downward. Thereby, the fixing pawls 8 are pivoted in a direction opposite the direction of arrow A, to be separated from the ribs 17. The cassette 1 is then popped up by the spring 14 shown in FIG. 3, to be disengaged from the carriage 2.

With this arrangement, when the cassette 1 is mounted, it need only be urged against the carriage 2 after the ink ribbon 3 is engaged with the ribbon guides 4. When the cassette 1 is disengaged, the pressing portion 8*a* need only be pressed downward. Therefore, the cassette 1 can be easily mounted on or demounted from the carriage 2, and is fixed thereto with high precision.

The ink ribbon 3 is moved downward by the ribbon guides 4 to allow easy observation of printed characters at a standby position. At a printing position, the ribbon 3 is moved upward by the guides 4 to be subjected to printing. At a delete position, the ribbon 3 is moved upward to a level higher than that of type elements on printing element 6. FIG. 3 shows the ribbon 3 at the standby and delete positions, with the printing position being located between the illustrated positions. As can be seen from FIG. 3, since the ink ribbon 3 is shifted vertically in accordance with the standby, delete, and printing modes and the length of the exposed portion of the ribbon 3 varies, this causes the ribbon 3 to be wound irregularly. However, in the ink ribbon cassette 1 of this embodiment, since the inclined portions 32, 33 are formed in the upper and lower ends of the guide bosses 1*a*, the ink ribbon 3 can be inclined through a given angle along the inclined portions 32, 33 on the take-up side, allowing it to be wound without being bent at either end or having the ink removed therefrom. At the supply side, transmission of vertical vibration can be prevented, thus similarly preventing bending of the ribbon 3 or removal of the ink.

When a large tension force is applied to the ink ribbon 3, the distal end 21*a* of the tension spring 21 is moved in the direction of arrow B, as shown in FIG. 2, and is guided to the corresponding boss 1*a*. Thereby, the ink ribbon 3 is shifted from the distal end 21*a* of the tension spring 21 which has a small radius of curvature, to the boss 1*a*, which has a large radius of curvature. Thus, bending of the ink ribbon 3 or poor ink transfer onto a recording sheet 5 can be prevented.

Figure 4:
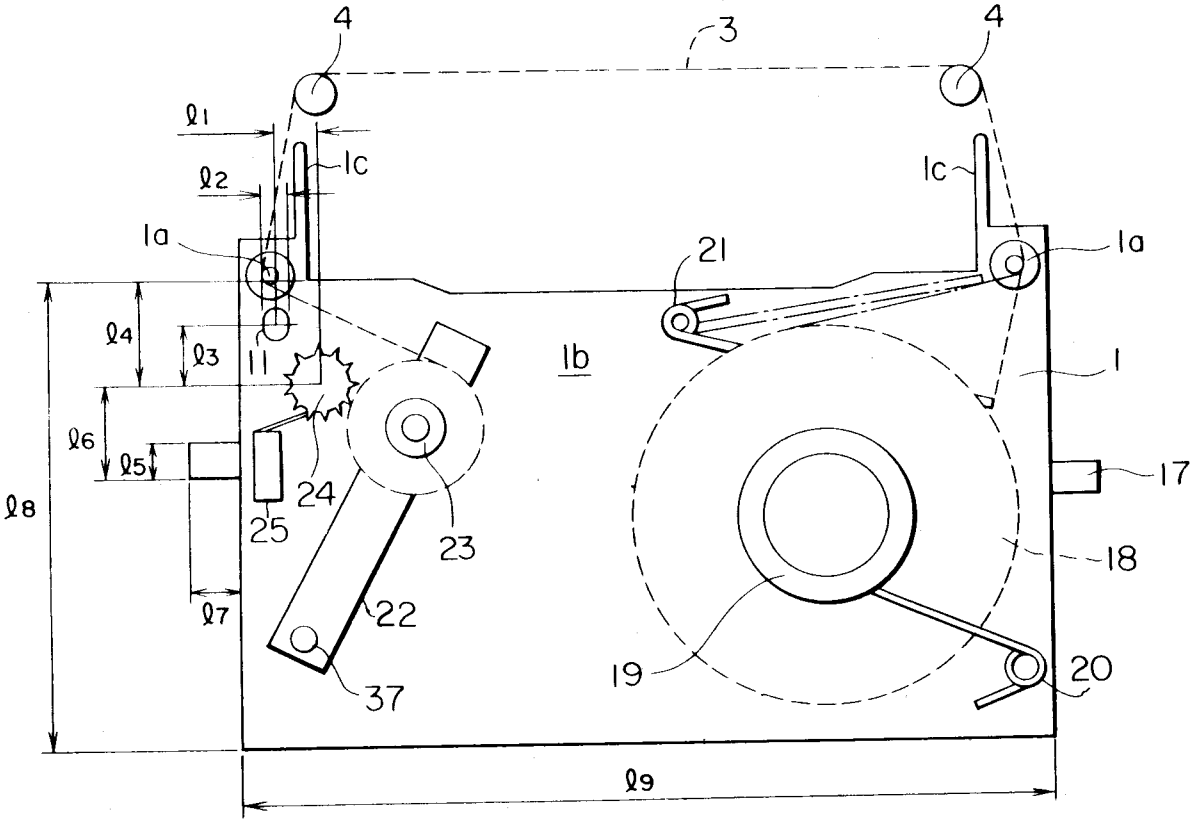
FIG. 4 is a plan view showing preferred dimensions of the ink ribbon cassette.

FIG. 4 shows preferred dimensions of the respective portions of the ink ribbon cassette 1. Referring to FIG. 4, $l_1=6.5$ mm, $l_2=4$ mm, $l_3=9$ mm, $l_4=15$ mm, $l_5=5$ mm, $l_6=13$ mm, $l_7=7.5$ mm, $l_8=67$ mm and $l_9=116$ mm. However, the present invention is not limited to these dimensions.

The ink ribbon used in the above embodiment can be a one-time ribbon, a correctable ribbon, or one of various other ribbons.

What I claim is:

1. An ink ribbon cassette, which houses an ink ribbon supplied from a casing and taken up therein after passing through a recording section, and which is detachably mounted on a carriage of a recording apparatus, comprising first positioning means for positioning said ink ribbon cassette in a first direction when said ink ribbon cassette is mounted on said carriage, and second positioning means for positioning said ink ribbon cassette in a second direction when said ink ribbon cassette is mounted on said carriage, and a tension spring for preventing slackening of the ink ribbon wherein at least one of said first and second positioning means is elastically engaged with positioning means of said carriage, and first and second ink-ribbon guide members disposed at ink-ribbon exit and entrance opening portions, respectively, each member including a linearly elongated portion whose length is substantially equal to the width of the ink ribbon and inclined end portions diverged conically toward the ends thereby when the ink ribbon between said first ink-ribbon guide member and said second ink-ribbon guide member is moved in the widthwise direction of the ink ribbon with respect to said ink ribbon cassette, slackening of the ink ribbon otherwise caused by the widthwise movement being absorbed by twisting the ink ribbon, the twisting causing the ink ribbon to bend.

2. A cassette according to claim 1, wherein said first positioning means is an engaging hole engaged with a boss formed on said carriage, and said second positioning means is a rib engaged with an elastic pawl formed on said carriage.

3. A cassette according to claim 1, wherein said ink ribbon cassette has a pair of substantially plate-like arms for supporting a back surface of said ink ribbon at said ink-ribbon exit and entrance opening portions.

* * * * *

UNITED STATES PATENT AND TRADEMARK OFFICE

CERTIFICATE OF CORRECTION

PATENT NO. : 4,798,486

DATED : January 17, 1989

INVENTOR(S) : Kaneko

It is certified that error appears in the above-identified patent and that said Letters Patent is hereby corrected as shown below:

COLUMN 2

Line 50, "portions 8b" should read --portions 8b.--; and

Line 53, "the corresponding ribs 17 at" should be deleted.

COLUMN 3

Line 56, "he" should read --the--.

Signed and Sealed this

Fifth Day of December, 1989

*Attest:*

JEFFREY M. SAMUELS

*Attesting Officer*

*Acting Commissioner of Patents and Trademarks*